US006666175B2

(12) United States Patent
Wand et al.

(10) Patent No.: US 6,666,175 B2
(45) Date of Patent: Dec. 23, 2003

(54) CLOSED LOOP RADIATOR WATER SYSTEM FOR AN INTERNAL COMBUSTION ENGINE

(75) Inventors: Norbert Wand, Friedrichshafen (DE); Michael Hartmann, Friedrichshafen (DE); Michael Groddeck, Meckenbeuren (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 10/179,282

(22) Filed: Jun. 26, 2002

(65) Prior Publication Data

US 2003/0024490 A1 Feb. 6, 2003

(30) Foreign Application Priority Data

Aug. 3, 2001 (DE) ..... 101 38 083

(51) Int. Cl.[7] ..... F01P 9/00

(52) U.S. Cl. ..... 123/41.01; 123/41.54

(58) Field of Search ..... 123/41.01, 41.54

(56) References Cited

FOREIGN PATENT DOCUMENTS

DE 1 882 762 11/1963

*Primary Examiner*—Noah P. Kamen
(74) *Attorney, Agent, or Firm*—Crowell & Moring LLP

(57) ABSTRACT

A closed loop cooling water system for an internal combustion engine includes a radiator, an inlet line connecting the radiator to the internal combustion engine, a cooling water pump disposed in the inlet line, the cooling water pump having a suction side, a compensating tank, a compressor connected to the compensating tank, and a connecting line connecting the compensating tank to the inlet line on the suction side of the cooling water pump. The compressor supplies compressed air to the compensating tank to set the pressure level in the compensating tank. The pressure level in the compensating tank affects the pressure level on the suction side of the cooling water pump during operation.

27 Claims, 2 Drawing Sheets

CLOSED LOOP RADIATOR WATER SYSTEM FOR AN INTERNAL COMBUSTION ENGINE

This application claims the priority of German Patent Document No. 101 38 083.6, filed Aug. 3, 2001, the disclosure of which is expressly incorporated by reference herein.

BACKGROUND AND SUMMARY OF THE INVENTION

The invention relates to a closed loop radiator water system for an internal combustion engine.

Usually a closed loop cooling water system is used for cooling an internal combustion engine. Critical in this respect is the possibility of forming vapor bubbles or cavitation, thus resulting in damages to the units and the lines.

From the prior art, for example DE 1 882 762, it is known to prevent cavitation by increasing the pressure level on the suction side of the cooling water pump. To this end, there is a connecting line from a compensating tank, filled with cooling water, to the suction side of the cooling water pump. The compensating tank also has air, which is fed through ventilation lines from the heat exchangers to the compensating tank. The air pressure has an impact on the pressure level in the compensating tank and, thus, on the pressure increase on the suction side of the cooling water pump. Thus, in this closed loop cooling water system, the temperature of the cooling water determines the pressure increase by the change in volume of the air. The problem is that the pressure does not begin to increase after the start of the internal combustion engine until the temperature of the radiator water increases.

In this respect the invention is based on the problem of designing a closed loop cooling water system, wherein the pressure rises faster.

The problem is solved with the invention as described hereinafter.

The invention provides that the pressure level in the compensating tank can be preset by a compressor. The compressor can be designed as a separate unit or as a component of an exhaust gas turbocharger. The use of a compressor has the advantage of a higher degree of freedom in the control of pressure increase on the suction side of the cooling water pump. Thus, it is easier to match the pressure increase to the operating point of the internal combustion engine. Thus, for example, immediately after the starting operation, the pressure level on the suction side of the cooling water pump can be raised to a safe operating value.

Between the compressor and the compensating tank there is a pressure control line, in which a pressure control valve and a non-return valve are disposed. In an embodiment of the invention, the pressure control valve can be designed as a simple spring-loaded valve. In another embodiment of the invention the pressure control valve can be designed as an electromagnetic valve, whose position is determined by an electronic control unit.

Other objects, advantages and novel features of the present invention will become apparent from the following detailed description of the invention when considered in conjunction with the accompanying drawings.

DETAILED DESCRIPTION OF THE DRAWINGS

Figure 1:
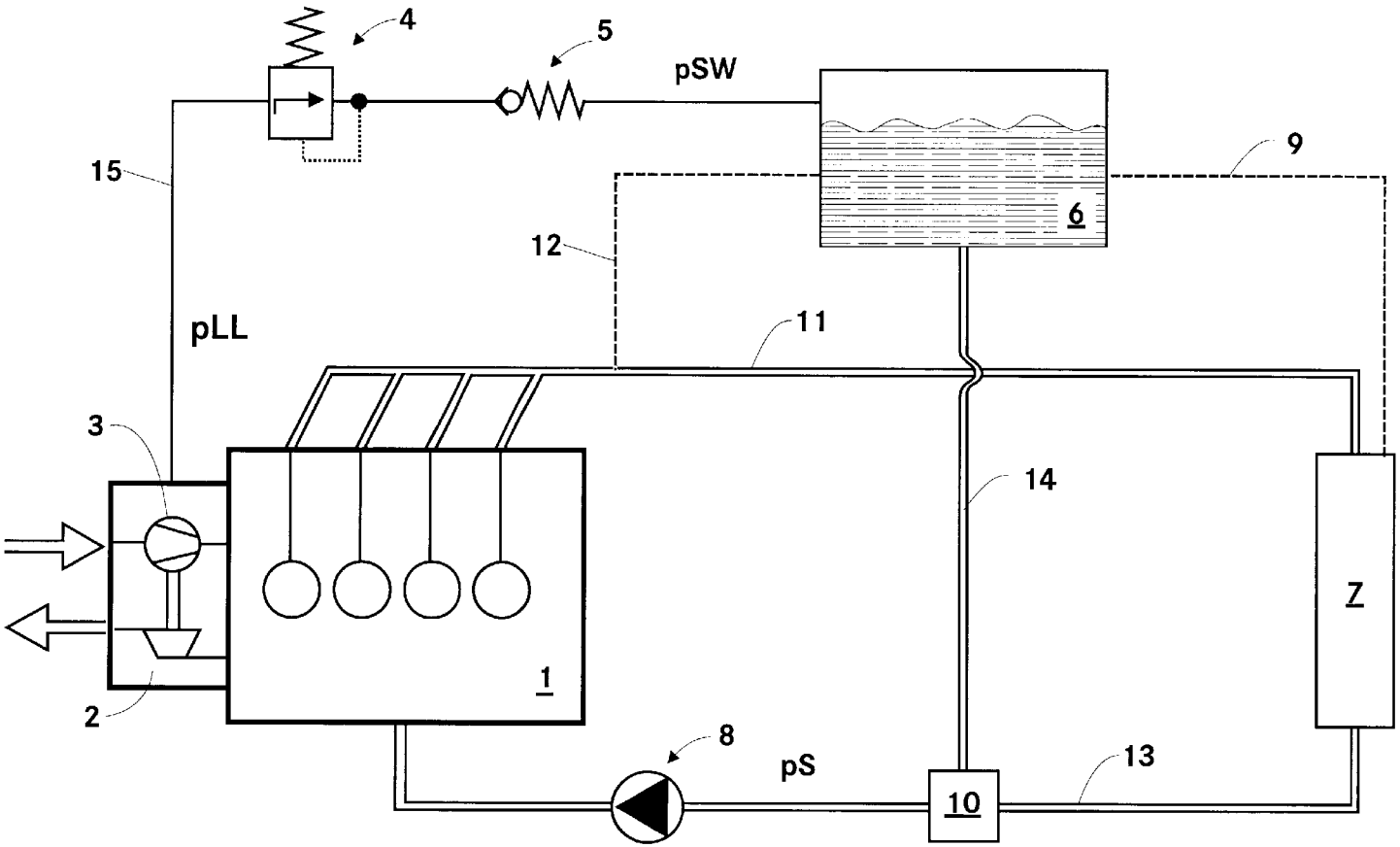
FIG. 1 is a first block diagram of a closed loop cooling water system of the present invention.

FIG. 1 is a first block diagram of a closed loop cooling water system in accordance with the present invention. It comprises the modules: an internal combustion engine 1, a compensating tank 6, a radiator 7 and a cooling water pump 8. In this respect the internal combustion engine 1, the line 11, the radiator 7, the inlet line 13 and the cooling water pump 8 form the actual cooling loop. From the high points of the internal combustion engine 1 and the radiator 7, the ventilation lines 9 and 12 lead to the compensating tank 6. Said tank serves as the reservoir for compensating for the change in volume of the cooling water on the basis of the temperature change. In addition, it has the task of cutting off the air from the ventilation lines 9 and 12. A connecting line 14 leads from the compensating tank 6 to the inlet line 13, thus on the suction side of the cooling water pump 8. At the junction there is a feeder 10, for example an injector. The compensating tank 6 is connected to a compressor 3 by way of a pressure control line 15. In this pressure control line 15 there is a pressure control valve 4 and a non-return valve 5. In the embodiment shown in FIG. 1, the pressure control valve 4 is designed as a simple spring-loaded valve. The compressor 3 can be designed as a separate unit or as a component of an exhaust gas turbocharger 2. The function of the arrangement is the following. A pressure level pLL is generated by the compressor 3. A constant pressure level pSW in the compensating tank 6 is set by the pressure control valve 4. The result of this pressure level is that the pressure level pS on the suction side of the cooling water pump 8 is raised. Cavitation is reduced by this pressure increase.

Figure 2:
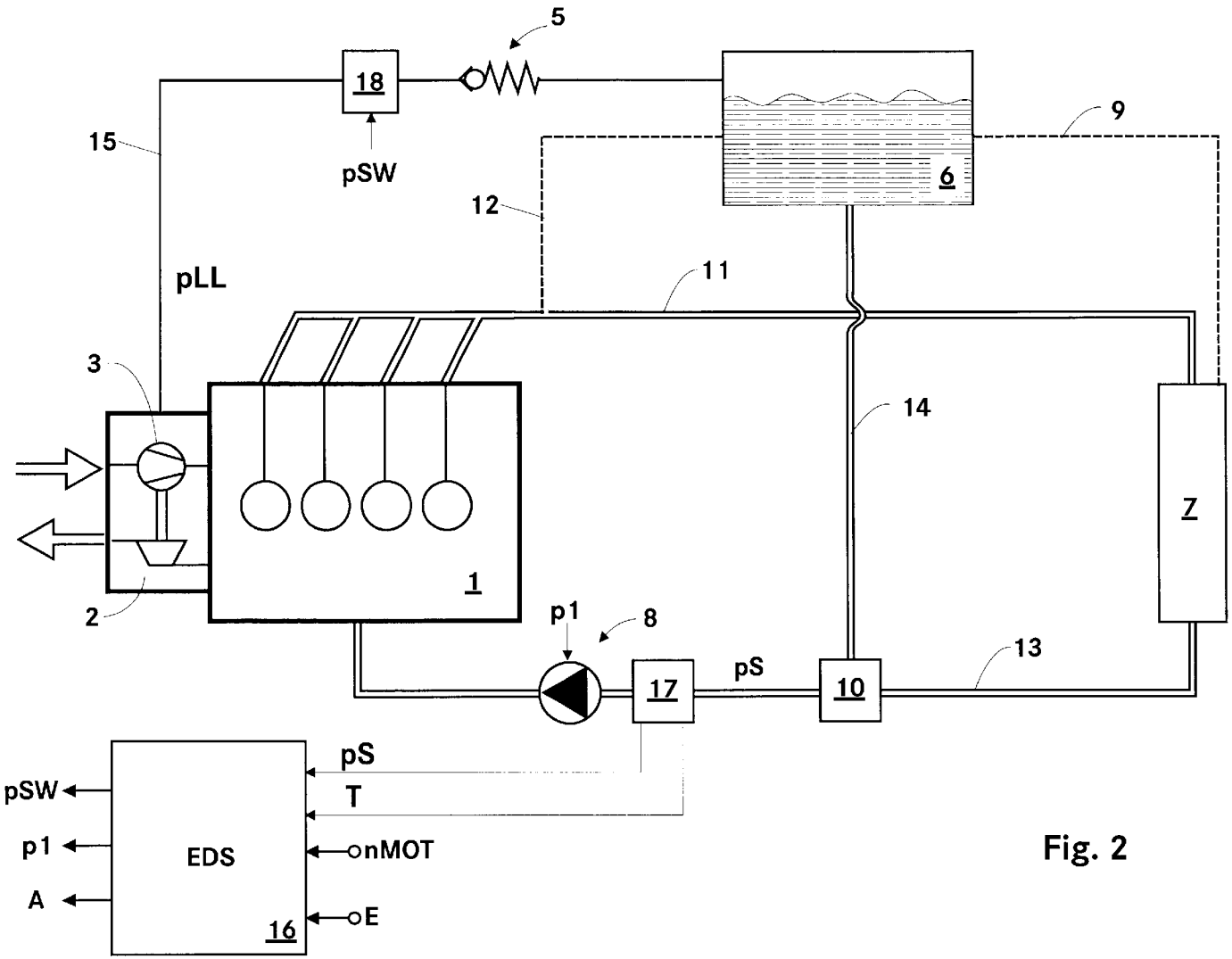
FIG. 2 is a second block diagram of a closed loop cooling water system of the present invention.

FIG. 2 shows a second block diagram of a closed loop cooling water system in accordance with the present invention. The embodiment in FIG. 2 differs from the embodiment in FIG. 1 in that the pressure increase on the suction side of the cooling water pump is determined by an electronic controller (EDS) 16. To this end, a valve 18 is provided in the pressure control line 15. The position of the valve 18 is determined by the electronic controller 16 as a function of the input variables. The input variables of the electronic controller 16 that are illustrated by way of an example in FIG. 2 are: the pressure level pS on the suction side of the cooling water pump 8, the temperature T of the cooling water, the engine speed nMOT and other input variables of the internal combustion engine that are indicated by the collective reference character E. The pressure level pS and the temperature T of the cooling water are already set by the measuring device 17. The output variables of the electronic controller 16 are the actuating signal pSW for the valve 18 and a reference value p1 for the cooling water pump 8. The collective reference character A denotes the other output variables for controlling the internal combustion engine 1, for example the start of injection and the amount of injection. The characteristics, required to control the pressure, are deposited in the electronic controller 16. The description of FIG. 1 applies to the functionality of the pressure increase.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

Patent claims

1. Closed loop cooling water system for an internal combustion engine with a radiator, a cooling water pump, a compensating tank, an inlet line from the radiator to the internal combustion engine, in which line the cooling water pump is disposed, and a connecting line, which connects the compensating tank to the inlet line, wherein the connecting line on a suction side of the cooling water pump empties into the inlet line, so that the pressure level on the suction side of the cooling water pump is affected by the pressure level in the compensating tank, wherein the pressure level in the compensating tank is preset by means of a compressor.

2. Closed loop cooling water system, as claimed in claim 1, wherein the compressor is a component of an exhaust gas turbocharger.

3. Closed loop cooling water system, as claimed in claim 2, wherein a pressure control line is disposed between the compressor and the compensating tank.

4. Closed loop cooling water system, as claimed in claim 3, wherein a pressure control valve and a non-return valve or an electronically controlled valve are disposed in the pressure control line.

5. Closed loop cooling water system, as claimed in claim 4, wherein a position of the electronically controlled valve is determined by an electronic controller as a function of an operating point of the internal combustion engine.

6. Closed loop cooling water system, as claimed in claim 1, wherein a feeder is arranged at the connecting point of the connecting line with the inlet line.

7. Closed loop cooling water system, as claimed in claim 1, wherein a pressure control line is disposed between the compressor and the compensating tank.

8. Closed loop cooling water system, as claimed in claim 7, wherein a pressure control valve and a non-return valve or an electronically controlled valve are disposed in the pressure control line.

9. Closed loop cooling water system, as claimed in claim 8, wherein a position of the electronically controlled valve is determined by an electronic controller as a function of an operating point of the internal combustion engine.

10. Closed loop cooling water system, as claimed in claim 9, wherein a feeder is arranged at the connecting point of the connecting line with the inlet line.

11. A closed loop cooling liquid system for an internal combustion engine comprising:

a radiator;

an inlet line operable in use to connect the radiator to an internal combustion engine;

a cooling liquid pump disposed in the inlet line, the cooling liquid pump having a suction side;

a compensating tank;

a compressor connected to the compensating tank, wherein the compressor supplies compressed air to the compensating tank to set the pressure level in the compensating tank; and a connecting line connecting the compensating tank to the inlet line on the suction side of the cooling liquid pump so that the pressure level in the compensating tank affects the pressure level on the suction side of the cooling liquid pump during operation.

12. The closed loop cooling liquid system, as claimed in claim 11, wherein the compressor is a component of an exhaust gas turbocharger of the engine.

13. The closed loop cooling liquid system, as claimed in claim 12, further comprising a pressure control line connecting the compressor to the compensating tank.

14. The closed loop cooling liquid system, as claimed in claim 13, further comprising a pressure control valve and a non-return valve, which valves are disposed in the pressure control line.

15. The closed loop cooling liquid system, as claimed in claim 13, further comprising an electronically controlled valve disposed in the pressure control line.

16. The closed loop cooling liquid system, as claimed in claim 15, wherein the position of the electronically controlled valve is determined by an electronic controller as a function of an operating point of the internal combustion engine.

17. The closed loop cooling liquid system, as claimed in claim 11, further comprising a feeder arranged at the connecting point of the connecting line and the inlet line.

18. The closed loop cooling liquid system, as claimed in claim 11, further comprising a pressure control line disposed between the compressor and the compensating tank.

19. The closed loop cooling liquid system, as claimed in claim 18, further comprising a pressure control valve and a non-return valve, which valves are disposed in the pressure control line.

20. The closed loop cooling liquid system, as claimed in claim 18, further comprising an electronically controlled valve disposed in the pressure control line.

21. The closed loop cooling liquid system, as claimed in claim 20, wherein the position of the electronically controlled valve is determined by an electronic controller as a function of an operating point of the internal combustion engine.

22. A method of making a closed loop cooling liquid system for an internal combustion engine comprising:

connecting a radiator to the internal combustion engine with an inlet line;

disposing a cooling liquid pump in the inlet line, the cooling liquid pump having a suction side;

connecting a compressor to a compensating tank, wherein the compressor supplies compressed air to the compensating tank to set the pressure level in the compensating tank; and connecting the compensating tank to the inlet line on the suction side of the cooling liquid pump with a connecting line so that the pressure level in the compensating tank affects the pressure level on the suction side of the cooling liquid pump during operation.

23. The method, as claimed in claim 22, further comprising using a component of an exhaust gas turbocharger of the engine as the compressor.

24. The method, as claimed in claim 23, further comprising disposing a pressure control valve and a non-return valve between the compressor and compensating tank.

25. The method, as claimed in claim 23, further comprising disposing an electronically controlled valve between the compressor and compensating tank.

26. The method, as claimed in claim 25, further comprising controlling the position of the electronically controlled valve as a function of an operating point of the internal combustion engine.

27. The method, as claimed in claim 22, further comprising disposing a feeder at the connecting point of the connecting line and the inlet line.

* * * * *